US006364100B1

(12) United States Patent
Leibeck

(10) Patent No.: US 6,364,100 B1
(45) Date of Patent: Apr. 2, 2002

(54) CASE FOR ROD-SHAPED OBJECTS

(75) Inventor: Christian Leibeck, Nürnberg (DE)

(73) Assignee: J. S. Staedtler GmbH & Co., Nürnberg (DE)

( * ) Notice: Subject to any disclaimer, the term of this patent is extended or adjusted under 35 U.S.C. 154(b) by 0 days.

(21) Appl. No.: 09/614,445

(22) Filed: Jul. 12, 2000

(30) Foreign Application Priority Data

Jul. 22, 1999 (DE) ..... 199 34 428

(51) Int. Cl.[7] ..... B65D 25/24; B65D 5/52

(52) U.S. Cl. ..... 206/45.23; 206/45.2; 206/443; 220/826

(58) Field of Search ..... 206/45.2, 45.23, 206/45.24, 443; 220/817, 819, 826

(56) References Cited

U.S. PATENT DOCUMENTS 1,879,029 A * 9/1932 Baumgard ..... 206/45.24
4,259,568 A * 3/1981 Dynesen ..... 206/45.24
4,465,184 A * 8/1984 Bruce ..... 220/826
D284,606 S * 7/1986 Koontz ..... D27/47

FOREIGN PATENT DOCUMENTS

| | | |
|---|---|---|
| DE | 39217781 | 12/1992 |
| DE | 198 23 215 A1 | 12/1999 |
| JP | 536516 | 2/1978 |

* cited by examiner

*Primary Examiner*—David T. Fidei
(74) *Attorney, Agent, or Firm*—Friedrich Kueffner

(57) ABSTRACT

A case for rod-shaped objects has at least one receptacle, a closure part, and a first hinge, wherein the first hinge articulates the receptacle and the closure part relative to one another. The closure part can be folded relative to the receptacle about the first hinge into an open position in which the rod-shaped objects are accessible and forms a positioning support for the case to hold the case in an erect position when the case is placed onto a supporting surface. The closure part has a bottom closure part, a top closure part, and a second hinge, wherein the second hinge articulates the bottom closure part and the top closure part relative to one another so that the top closure part and the bottom closure part are foldable and pivotable relative to one another.

16 Claims, 3 Drawing Sheets

CASE FOR ROD-SHAPED OBJECTS

BACKGROUND OF THE INVENTION

1. Field of the Invention

The invention relates to a case for rod-shaped objects, especially for pens or instruments for writing, drawing, painting, marking or cosmetics, comprised of at least one receptacle and a closure part, wherein both parts are articulated to one another.

2. Description of the Related Art

Such a case, for example, is known from German patent document 39 21 781, published on Jan. 10, 1991. The "hard plastic case" disclosed in this document has a foldable lid which is articulated on the case such that a guide pin glides in a guide groove when the lid is pivoted to thereby provide a supported positioning of the lid. In this configuration the removal position or the slanted position of the case results from the design of the guide groove and the movement of the lid bearing. Overall, this is a relatively expensive case design with very limited positioning possibilities.

From Japanese patent document GM/AS 53-6516, published on Feb. 18, 1978, it is known to provide a so-called soft plastic case with a reinforcement in the area of the closure part or a cover in order to thus provide a support when the closure part is folded downwardly. This support makes it possible to position the case at a slant in a preferred removal position. A carrying strap is designed to provide an additional securing action for the removal position. This configuration provides a relative expensive solution, even though the case in itself is basically inexpensive. This solution is moreover unstable, and it is not apparent how a safe fixation in the removal position could result.

For both cases it is also not apparent whether and how they can be filled by machines, i.e., automatically, if needed.

Moreover, in the German patent document 19823215 A1, published on Dec. 2, 1999, a method for producing a container for elongate objects is disclosed wherein the container is in the form of a case comprised of a downwardly pointing front part and a bottom part produced by stamping and subsequent welding, wherein a stamped separating line that can be pulled open separates the front part into a top member and a bottom member. The case is to be filled before the front part and the bottom part are welded together. The top member is furthermore dividable into a cover strap and a grip strap wherein the grip strap can be used optionally as a support member to erect the case. Since in the illustration of this embodiment the cover strap required for erecting the case is considerably longer than the pivotable grip strap, a safe erect position is not provided. Instead, it appears that this case cannot ensure any safe erect position so that without any further information in this respect no useful teaching as regards an erecting aid is provided. Moreover, since such cases are still processed with exposure to heat or by other welding or gluing techniques, there is also the risk of damaging or additionally soiling sensitive writing or drawing pens filled with ink during the welding process.

SUMMARY OF THE INVENTION

It is an object of the present invention to provide an inexpensive, stable but still automatically fillable case for rod-shaped objects, which allows easy filling with the objects and easy removal of the objects therefrom but still secures the objects safely and embodies or has moreover an effective auxiliary means for positioning in a removal-friendly position, respectively, for erecting the case, for example, at the workplace.

In accordance with the present invention, this is achieved in that the closure part is connected with the receptacle by means of a defined folding hinge in an articulated and foldable manner, in that the closure part is divided and embodied to be folded open and is comprised of a top closure and a bottom closure part, and in that the top and bottom closure parts are foldably connected with another by a defined closure hinge and are arranged to be pivotable relative to one another.

Further details and developments of the suggested solution are explained in the following description of the preferred embodiments.

DESCRIPTION OF THE PREFERRED EMBODIMENTS

Figure 1:
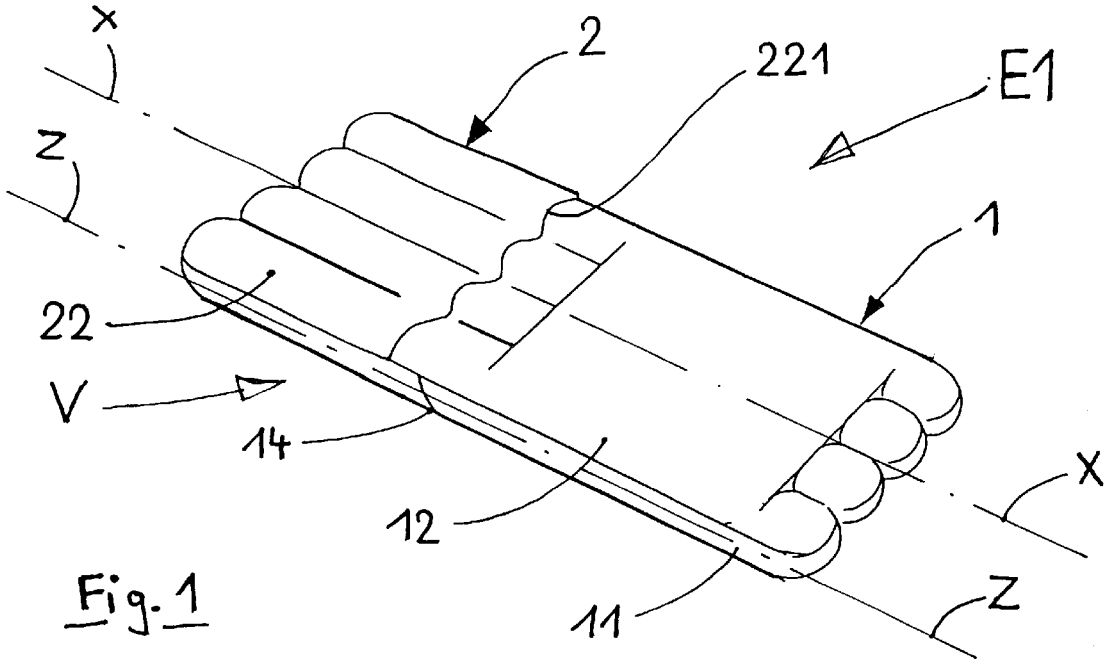
FIG. 1 shows a first case (E1) in the closed position (V)
Figure 2:
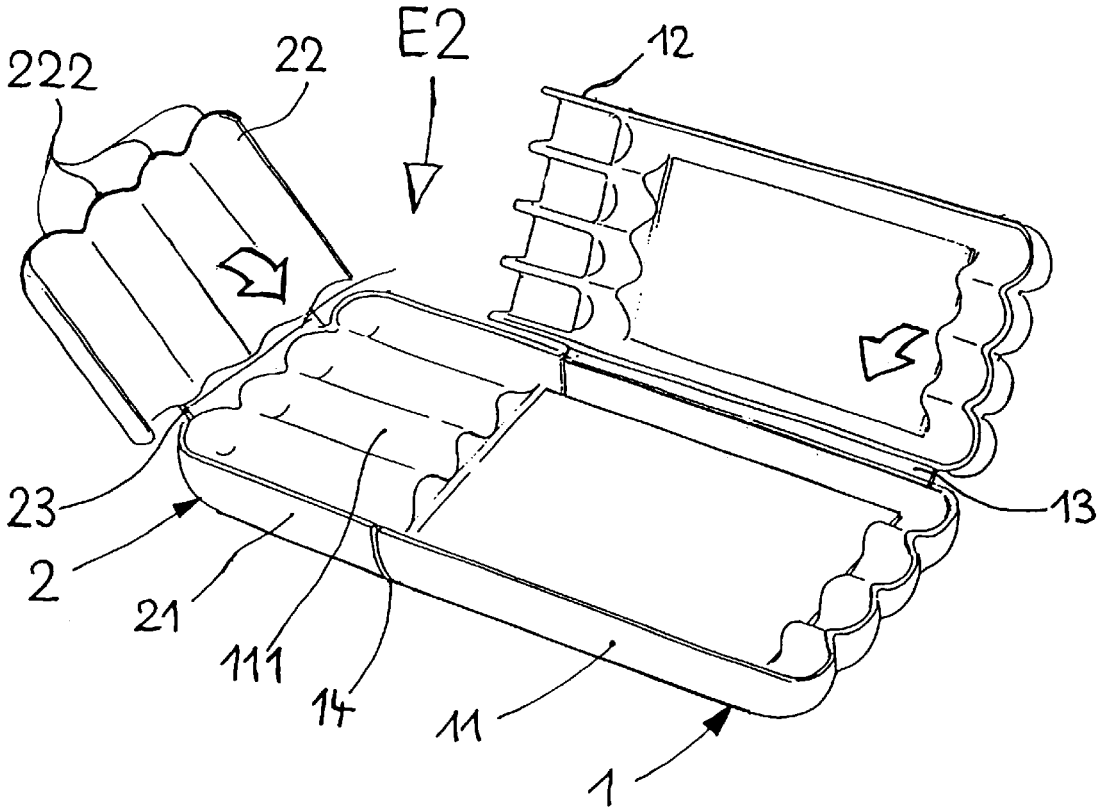
FIG. 2 shows a second case (E2) in the open position and empty.

The cases E1 and E2 illustrated in FIGS. 1 and 2 each have a receptacle 1 which is formed of a bottom shell 11 and a cover shell 12 which are connected to one another along a closure axis z extending parallel to the longitudinal case axis x. The closure part 2 is comprised of a bottom closure part 21 and a top closure part 22 which are fixedly but pivotably supported and connected, on the one hand, to one another by means of the closure hinge 23 and, on the other hand, to the bottom shell 11 by means of a folding hinge 14. The support edges 221 or the wave peaks 222 form the end face contour of the top closure part 22. The receptacle hinge 13 is arranged parallel to the longitudinal axis x of the case along one longitudinal side of the bottom shell 11 and the cover shell 12. As an alternative to this configuration, it may also be advantageous to provide a hinge-like connection between the bottom shell 11 and the cover shell 12 on the bottom profile 15. This results in a uniform elongate arrangement of all individual parts 11, 12, 21, 22 which are connected to one another by means of film hinges 13, 14, 23.

Figure 3:
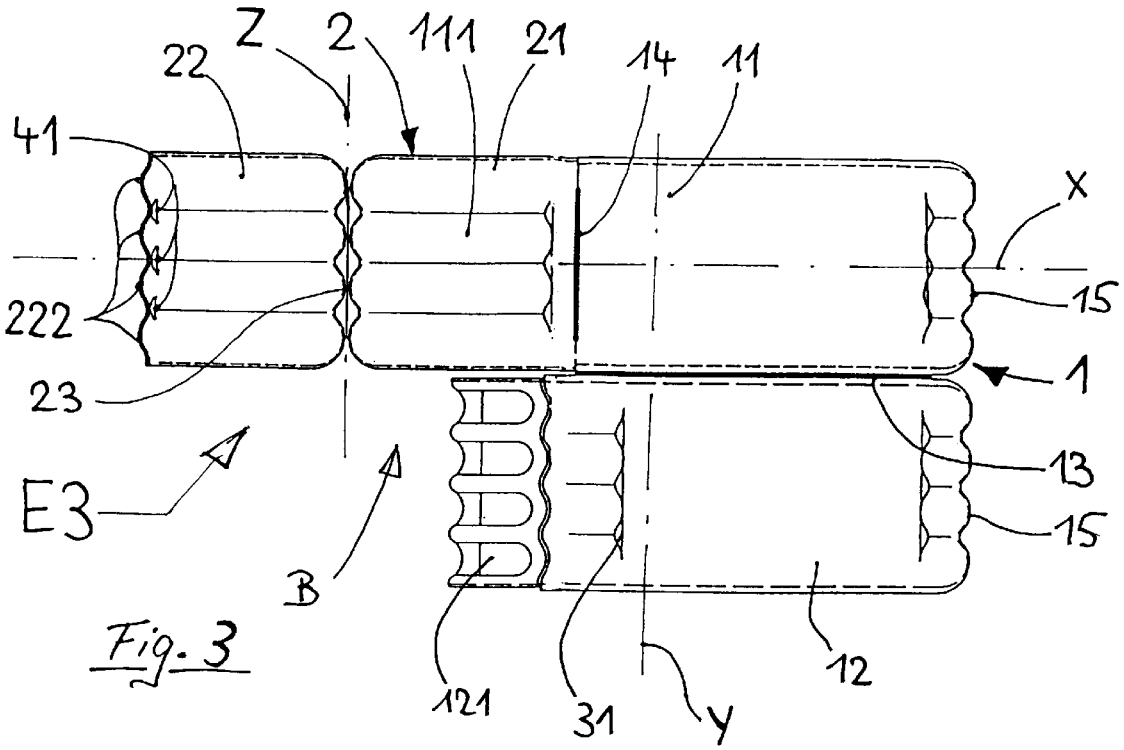
FIG. 3 shows a third open case (E3) in the filling position (B)

FIG. 3 shows a further case E3 in the open position or in the filling position B wherein in this configuration the receptacle hinge 13 is arranged on the other side of the case axis x. As an alternative, this receptacle hinge can also be advantageously provided as a film hinge on the bottom profile 15 of the two receptacle shells 11 and 12.

The bottom shell 11 of the receptacle 1 is delimited axially by the folding hinge 14 which has connected thereto the bottom closure part 21 of the closure part 2. The bottom closure part 21 has securing elements 111 for receiving and securing the rod-shaped objects in an aligned arrangement. The closure hinge 23, which is also embodied as a film hinge, extends along the transversely oriented closure axis z. The top closure part 22 is connected to the closure hinge 23 and is delimited opposite the closure hinge 23 by wave peaks 222. In the filling position B the two top and bottom closure parts 21, 22 are either opened in a stretched position or additionally folded downwardly in order to be able to easily insert the rod-shaped objects parallel to the case axis X. The cover shell 12 of the receptacle 1, which is also folded open, has recesses 121 for receiving and position-securing, for example, securing clips, often provided on writing instruments, or other projecting parts and also has centering elements 31, wherein catch elements 41 may snap into the outer depressions of the centering elements 31 for safely locking the closed case.

Figure 4:
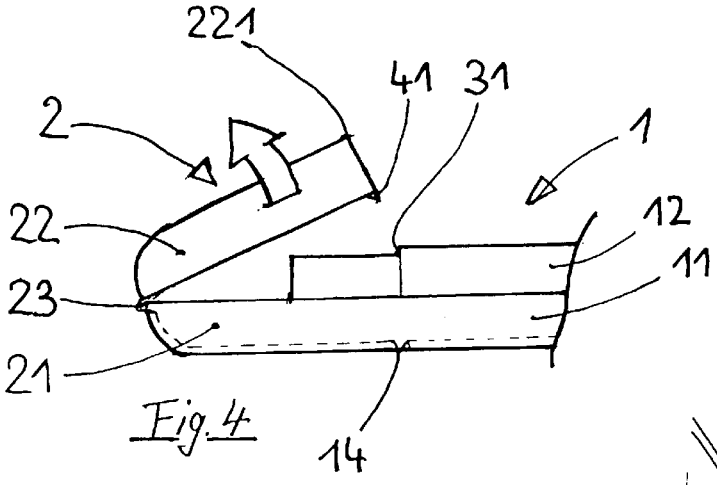
FIG. 4 shows a partially open case, showing a detail.

FIG. 4 shows a detail of a partially open case whose receptacle 1, comprised of a bottom shell 11 and a cover shell 12, has centering elements 31 in the closure area which are engaged by catch elements 41 when the case is in the completely closed position. In the illustrated, partially open position it can also be seen that on the folding hinge 14, embodied as a film hinge, the bottom closure part 21 is formed as a unitary part and that the top closure part 22 of the closure part 2 adjoins the closure hinge 23 and ends with support edges 221.

Figure 5:
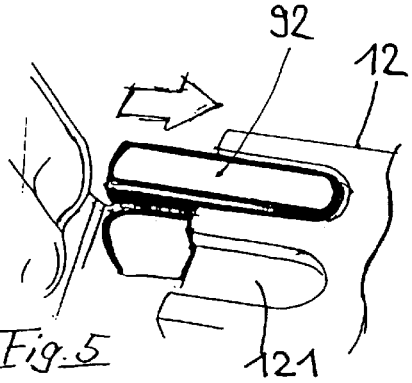
FIG. 5 is a partial view of a case with contents.

FIG. 5 shows a partial view of a case with contents wherein the securing clip 92 of an inserted writing instrument is received in a cutout 121 of a cover shell 12 in a position-secured way.

Figure 6:
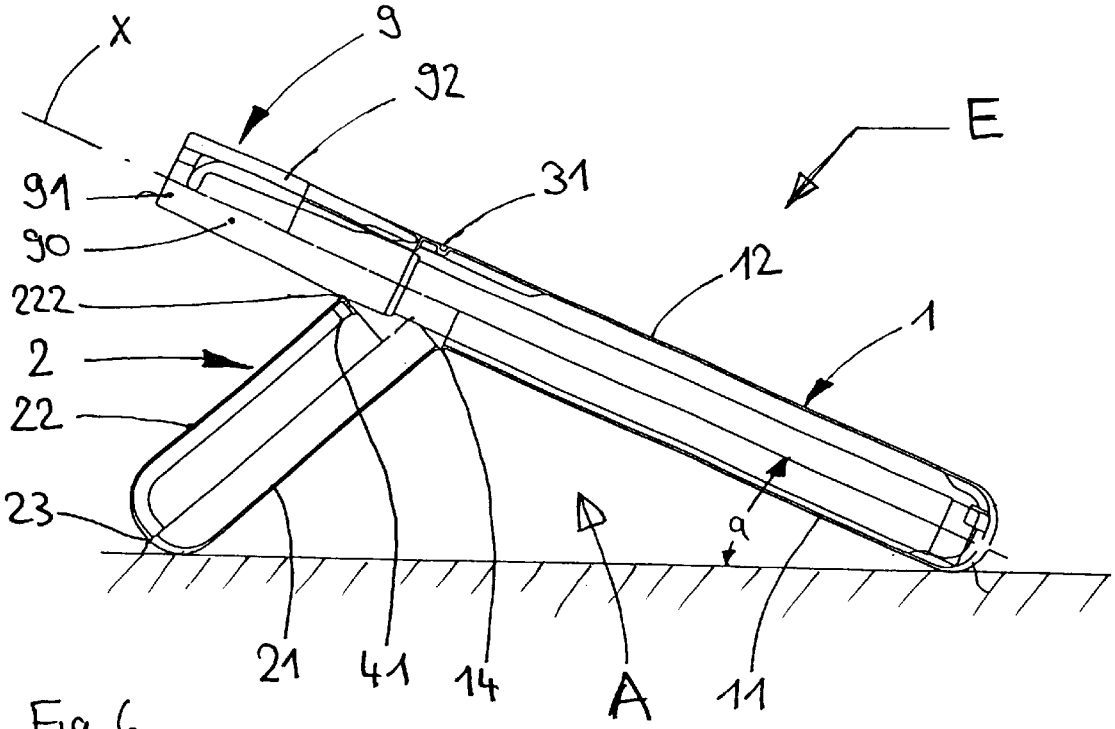
FIG. 6 is a case (E) in the erect position (A)

According to FIG. 6, a case E is illustrated in an erect position A wherein rod-shaped objects 9 or writing instruments 91 are inserted in the receptacle 1, comprised of a bottom shell 11 and a cover shell 12, and wherein the wave peaks 222 of the closure part 2 rest on the circumference 90 of the rod-shaped objects 9 or writing instruments 91. One wave peak 222 rests respectively against each inserted object 9 with a contact point and thus supports the case E in its erect position A which can be realized by pivoting the receptacle 1 relative to the closure part 2 by means of the folding location provided by the folding hinge 14. The closure part 2 provides the positioning support for the erect position of the case. The slant angle a of the erect position depends, on the one hand, on the ratio of the lengths of the bottom shell 11 to the bottom closure part 21 and, on the other hand, on the ratio of the lengths of the bottom closure part 21 to the top closure part 22, which are connected to one another by the closure hinge 23 and in the erect position A are also connected fixedly but detachably to one another by a positive-locking or frictional connection.

When the erect position (position of use) A is abandoned by picking up the case E and further folding the closure part, the closure part 2 can be opened and can be placed in the open state over the contents 9, 91 to then be closed again. In the closed state the catch elements 41 arranged at the top closure part 22 engage the centering elements 31 provided on the cover shell 12 and effect thereby an additional transverse stabilization of the closed case because any axial movement oriented along the case axis x is prevented with this configuration.

Figure 7:
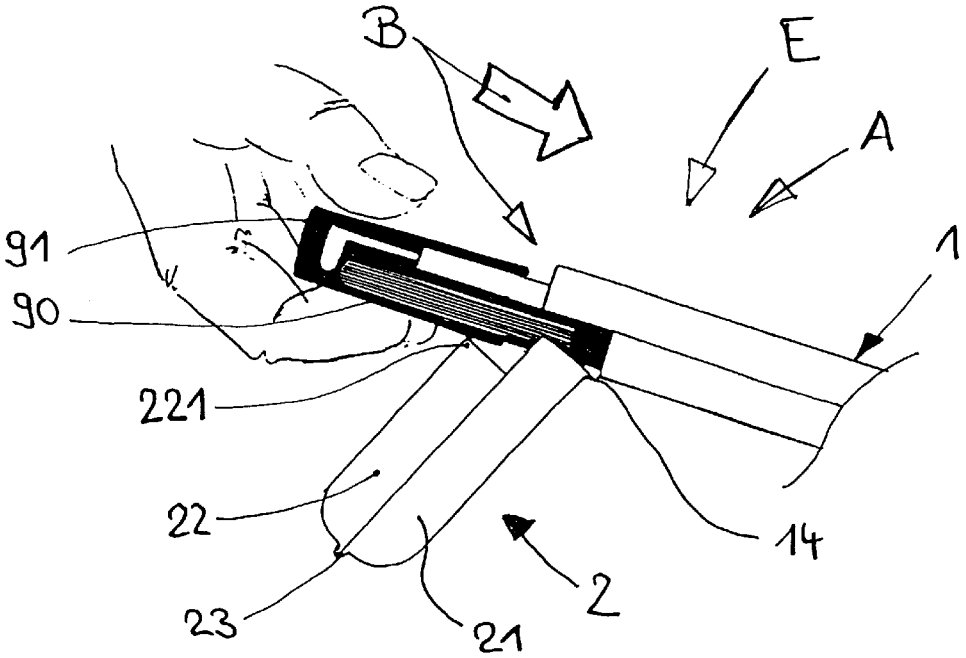
FIG. 7 shows an open case (E) in the removal position or filling position (B).

FIG. 7 shows finally an open case E in the filling position B, for example, for manual filling, or in the removal position, wherein this removal position can be simultaneously the position of use A. A writing instrument 91 is guided into the receptacle 1 or removed therefrom, wherein the support edge 221 of the top closure part 22 of the closure part 2 rests against the circumference 90 of the writing instrument. The two top and bottom closure parts 21, 22 connected by the closure hinge 23 are also connected to one another by a positive-locking connection fixedly but detachably at any time.

The proposed case for rod-shaped objects, especially for pens or instruments for writing, drawing, painting, marking or cosmetics, which is comprised of at least one receptacle (1) and a closure part (2) and wherein both components (1, 2) are articulated with one another, is to be designed such that the closure part (2) that is pivotably connected on the receptacle (1) has a bottom closure part (21) and a top closure part (22), that it is divided and designed to be foldable, and that the closure part (2) is additionally configured as an erecting aide or positioning support for the case so that the case can be positioned in a defined erect position (A) or position of use (A) and can be secured therein.

Moreover, the case according to the invention for rod-shaped objects, especially for writing, drawing, or painting instruments, comprised of several components (1, 2) articulated with one another and movable relative to one another and comprised of a bending-resistant material, wherein at least one receptacle (1) and a closure part (2) are connected with one another so as to be pivotable to one another and wherein, when the case is open, the receptacle (1) can be positioned or secured by the closure part (2) in a defined slanted position, can be designed such that the closure part (2) is comprised of a bottom closure part (21) and a top closure part (22) and that both top and bottom closure parts (21, 22) are foldably connected to one another by a closure hinge (23) and are pivotable arranged relative to one another and that the closure part (2) is connected with the receptacle (1) by a folding hinge (14) in an articulated and foldable manner.

Such a case can be further developed, inter alia, in that the hinges (13, 14, 23) or the connections of the two components (1, 2) are formed as film hinges and that both components (1, 2) are thereby connected in an articulated way but otherwise are fixedly connected to one another.

Preferably, the folding hinge (14) and the closure hinge (23) should be arranged transversely or perpendicularly to the case axis (x) and extending parallel to the transverse axis (y), and the receptacle (1) and the closure part (2) should be made of bending-resistant but still permanently elastic plastic material, especially, polypropylene, that is optionally transparent.

The receptacle (1) is advantageously comprised of a bottom shell (11) and a cover shell (12), and the bottom shell (11) and the cover shell (12) are preferably connected by a receptacle hinge (13) to one another.

The bottom shell (11) and the cover shell (12) as well as the two top and bottom closure parts (21, 22) are preferably fixedly but, if needed, detachably and lockably connected to one another by positive-locking, frictional or material connection means. For this purpose, tongue and groove connections, catch projections or other hook connections can be used.

A further advantage is realized when at least in one of the receptacle (1) and/or closure part (2) securing elements (111) are provided for a position-correct positioning of the rod-shaped objects (9, 91) to be received in the case and when the receptacle (1) and the closure part (2) can be secured on one another in the closed position (V) by means of positive-locking catch elements (41) and corresponding centering elements (31).

The positive-locking catch elements (41) used in this context and the complementary centering elements (31) should be designed and arranged such that the receptacle (1) and the closure part (2) are stabilized relative to one another in the closed position (V) and are also secured against movements and displacements oriented in the longitudinal direction to the case axis (x) as well as transverse thereto.

It is furthermore advantageous when the bottom closure part (21 and the top closure part (22) are also provided with positive- and/or frictional connecting means and can be locked relative to one another in an easily detachable manner. Both top and bottom closure parts (21, 22) should moreover have different lengths wherein, beginning at the closure hinge 23, the top closure part (22) should be shorter than the bottom closure part (21). The different lengths of the two top and bottom closure parts (21, 22) should be dimensioned such that the case in the erect position (A) has a slant angle (a) which is between 10 and 50, preferably between 20 and 30 degrees.

For facilitating removal of the rod-shaped objects, it is especially advantageous when the support edge (221) of the top closure part (22) is configured such that only a point contact is formed on the inserted rod-shaped objects (9, 91) in the erect position (A) of the case. This can be achieved, in particular, when the support edge (221) of the top closure part (22) is wave-shaped such that in the erect position (A) of the case one wave peak (222) rests directly against the circumference (90) of a respective inserted rod-shaped object.

While specific embodiments of the invention have been shown and described in detail to illustrate the inventive principles, it will be understood that the invention may be embodied otherwise without departing from such principles.

What is claimed,is:

1. A case for rod-shaped objects, comprising at least one receptacle, a closure part, and a first hinge, wherein the first hinge articulates the receptacle and the closure part relative to one another, wherein the closure part is configured to be folded relative to the receptacle about the first hinge into an open position in which the rod-shaped objects are accessible and forms a positioning support for the case to hold the case in an erect position when the case is placed onto a supporting surface, wherein the closure part is comprised of a bottom closure shell part, a top closure shell part, and a second hinge, wherein the second hinge articulates the bottom closure shell part and the top closure shell part relative to one another so that the top closure shell part and the bottom closure shell part are foldable and pivotable relative to one another, wherein the receptacle and the closure part are made of a bending-resistant but permanently elastic plastic material, and wherein the top closure shell part and the bottom closure shell part are configured to be connected to one another by positive-locking means, frictional locking means or material connection means so as to be fixedly but detachably and lockably connected to one another.

2. A case for rod-shaped objects, comprising at least one receptacle, a closure part, and a first hinge, wherein the first hinge articulates the receptacle and the closure part relative to one another, wherein the closure part is configured to be folded relative to the receptacle about the first hinge into an open position in which the rod-shaped objects are accessible and forms a positioning support for the case to hold the case in an erect position when the case is placed onto a supporting surface, wherein the closure part is comprised of a bottom closure part, a top closure part, and a second hinge, wherein the second hinge articulates the bottom closure part and the top closure part relative to one another so that the top closure part and the bottom closure part are foldable and pivotable relative to one another, wherein the receptacle is comprised of a bottom shell, a cover shell, and a third hinge, wherein the third hinge pivotably connects the bottom shell and the top shell.

3. The case according to claim 1, wherein the first hinge is a film hinge configured to connect the receptacle and the closure part fixedly but pivotably to one another and wherein the second hinge is a film hinge configured to connect the bottom closure shell part and the top closure shell part fixedly but pivotably to one another.

4. The case according to claim 1, wherein the first and second hinges are positioned perpendicularly to a longitudinal axis of the case.

5. The case according to claim 2, wherein the receptacle and the closure part are made of a bending-resistant but permanently elastic plastic material.

6. The case according to claim 1, wherein the plastic material is polypropylene.

7. The case according to claim 1, wherein the plastic material is transparent.

8. The case according to claim 2, wherein the bottom shell and the cover shell are configured to be connected to one another by positive-locking means, frictional locking means or material connection means so as to be fixedly but detachably and lockably connected to one another.

9. The case according to claim 1, wherein at least one of the receptacle and the closure part has securing elements configured to position the rod-shaped objects in a predetermined position in the case.

10. The case according to claim 1, wherein the receptacle has centering elements and the closure part has positive-locking catch elements, wherein the centering elements and the catch elements are configured to positive-lockingly engage one another in a closed position of the case and to secure the receptacle and the closure part on one another.

11. The case according to claim 10, wherein the positive-locking catch elements and the centering elements are configured such that the receptacle and the closure part are stabilized relative to one another in the closed position and are secured against movements in the direction of the longitudinal axis and transverse to the longitudinal axis.

12. The case according to claim 1, wherein the top closure shell part and the bottom closure shell part each have a length beginning at the second hinge and extending in the longitudinal direction, wherein the length of the top closure shell part is shorter than the length of the bottom closure shell part.

13. The case according to claim 12, wherein the length of the top closure shell part and the length of the bottom closure shell part are configured such that in the position of use the receptacle has a slant angle of between 10 and 50 degrees to the supporting surface.

14. The case according to claim 13, wherein the slant angle is between 20 and 30 degrees.

15. The case according to claim 12, wherein the top closure shell part has a support edge configured to provide only a point contact on the rod-shaped objects positioned in the case when the case is in the erect position.

16. The case according to claim 12, wherein the top closure shell part has a wave-shaped support edge with wave peaks wherein the support edge is configured such that each one of the wave peaks contacts a circumference of one of the rod-shaped objects positioned in the case when the case is in the erect position.

* * * * *